United States Patent [19]

Iannelli

[11] 4,448,036

[45] May 15, 1984

[54] REFRIGERATION SYSTEM

[75] Inventor: Frank M. Iannelli, Spartanburg, S.C.

[73] Assignee: Gerlach Industries Inc., Spartanburg, S.C.

[21] Appl. No.: 486,252

[22] Filed: Apr. 18, 1983

Related U.S. Application Data

[63] Continuation-in-part of Ser. No. 316,873, Oct. 30, 1981, abandoned.

[51] Int. Cl.[3] ..... F25D 17/00; B67D 5/62

[52] U.S. Cl. ..... 62/178; 62/201; 62/392; 165/109 R

[58] Field of Search ..... 62/180, 178, 201, 392; 165/109, 32; 366/144, 145

[56] References Cited

U.S. PATENT DOCUMENTS

| | | |
|---|---|---|
| 2,039,556 | 5/1936 | Ruse . |
| 2,055,022 | 9/1936 | Wood . |
| 2,470,936 | 5/1949 | Gerfo . |
| 2,978,878 | 4/1961 | Curtis et al. . |
| 3,056,273 | 10/1962 | Cornelius . |
| 3,263,442 | 8/1966 | Timmersman . |
| 3,400,551 | 9/1968 | Booth et al. . |

*Primary Examiner*—William E. Wayner
*Attorney, Agent, or Firm*—Dority & Flint

[57] ABSTRACT

A refrigeration system for cooling beverages as they are drawn from a plurality of containers and dispensed through a plurality of faucets. A pair of beverage dispensing coils are centrally carried in a housing which is filled with water. A refrigeration coil encircles the housing causing a build up of ice to take place on the inner wall of the housing. A temperature sensor is carried within a helical coil provided between the beverage dispensing coil and the ice bank for operating a compressor associated with the refrigeration coil. A power-driven paddle is centrally carried within the container for circulating the water therein and a gentle, wiping motion. In order to selectively turn on and off the power paddle, a second temperature sensor is located in a junction provided between the inputs of the beverage dispensing coils. As a result, any time a beverage is drawn from the device, the incoming warm beverage will activate the motor associated with the paddle wheel for circulating the water therein to ensure proper and efficient cooling of the beverages.

3 Claims, 3 Drawing Figures

REFRIGERATION SYSTEM

This application is a continuation-in-part application of Application Ser. No. 06/316,873 filed on Oct. 30, 1981, now abandoned entitled BEVERAGE COOLING DEVICE.

BACKGROUND OF THE INVENTION

Heretofore, normally kegs of beer have to be refrigerated from the time they leave the brewery until they are used in order to avoid spoiling of the beer. This requires refrigerated trucks for transporting the kegs of beer from the brewery to a refrigerated storage warehouse and refrigerated trucks for distributing the kegs to the ultimate users. The cool kegs of beer are then stored in a refrigerated area at the establishment where they are ultimately to be used and, as they are used, they must be maintained in a refrigerated cabinet. As can be seen, such is an expensive and cumbersome way of dispensing tap beer. Recently, however, breweries have begun pasteurizing beer placed in kegs, and as a result, the beer does not have to be refrigerated. However, the beer does have to be cooled prior to being consumed. Normally, wine is shipped to the establishment where it is ultimately to be served in an unrefrigerated plastic container. These containers normally have to be refrigerated prior to use.

Attempts have been made to provide beverage dispensers which are capable of cooling the beverage as it passes between a keg and a dispensing faucet. One such device is disclosed in U.S. Pat. No. 3,056,273. Other devices are disclosed in U.S. Pat. Nos. 2,470,936–3,263,442 and 2,039,556. While the device disclosed in U.S. Pat. No. 3,056,273 does disclose a beverage dispenser that is capable of cooling the beverage as it is drawn from a container, no details of the control utilized with the apparatus for controlling the thickness of an ice bank provided therein is disclosed.

Another problem with the apparatus disclosed in U.S. Pat. No. 3,056,273 is that it utilizes a helical blade for circulating water upwardly within a container to cool water carried within a pump. As a result of the use of this helical blade, there will not be an even wiping motion of the water within the container across the surface of the ice bank. This, in turn, will cause the ice bank to be uneven.

SUMMARY OF THE INVENTION

A refrigeration system, constructed in accordance with the present invention, is provided for cooling beverages as they are drawn from separate containers and dispensed through faucets. The system includes a housing which is filled with water and has an evaporator coil carried therein which extends from adjacent the top of the housing to adjacent the bottom. A refrigerant is circulated through the evaporator coil for causing an ice bank to build up on the inner wall of the housing. A pair of vertically extending beverage dispensing coils are centrally carried within the container. The beverage dispensing coils have a predetermined outside diameter so as to provide a space between the inside wall of the container and the beverage dispensing coil for allowing said bank of ice to build up on the inside walls of the container.

A faucet is connected to each of the beverage dispensing coils with the beverage dispensing coils connected between the containers of warm beverage and the faucet.

A helical tube is supported on brackets carried by one of the beverage dispensing coils and is provided for receiving an elongated temperature sensing probe. This probe encircles the beverage dispensing coils and any time the ice bank approaches any portion of the elongated helical tube it will cause the compressor to be turned off.

A power-driven paddle is carried within the beverage dispensing coil for circulating the water within the container in a wiping motion so as to provide a gentle and even wiping action over the surface of the ice bank. The paddle is substantially rectangular in shape and extends from adjacent the top of the container to adjacent the bottom.

The inlet ends of the beverage dispensing coils are positioned side by side to form a junction. A second temperature sensor is carried in the junction in heat transfer relation with said inlet ends of said beverage dispensing coils for sensing when a beverage is being drawn from one of the containers. The second temperature sensor is operably connected to the power-driven paddle for activating the paddle responsive to beverage being drawn from either of the faucets.

Accordingly, it is an important object of the present invention to provide a sensor for activating the power driven paddle for circulating water within a beverage dispensing container responsive to beverages being drawn from a faucet.

Another important object of the present invention is to provide a system which is capable of dispensing beverages from a plurality of containers through a plurality of faucets for intermittently operating a water circulation system provided in the container to ensure a uniform build up and melting of an ice bank provided therein.

These and other object and advantages of the invention will become apparent upon reference to the following specification, attendant claims, and drawings.

DESCRIPTION OF A PREFERRED EMBODIMENT

Figure 1:
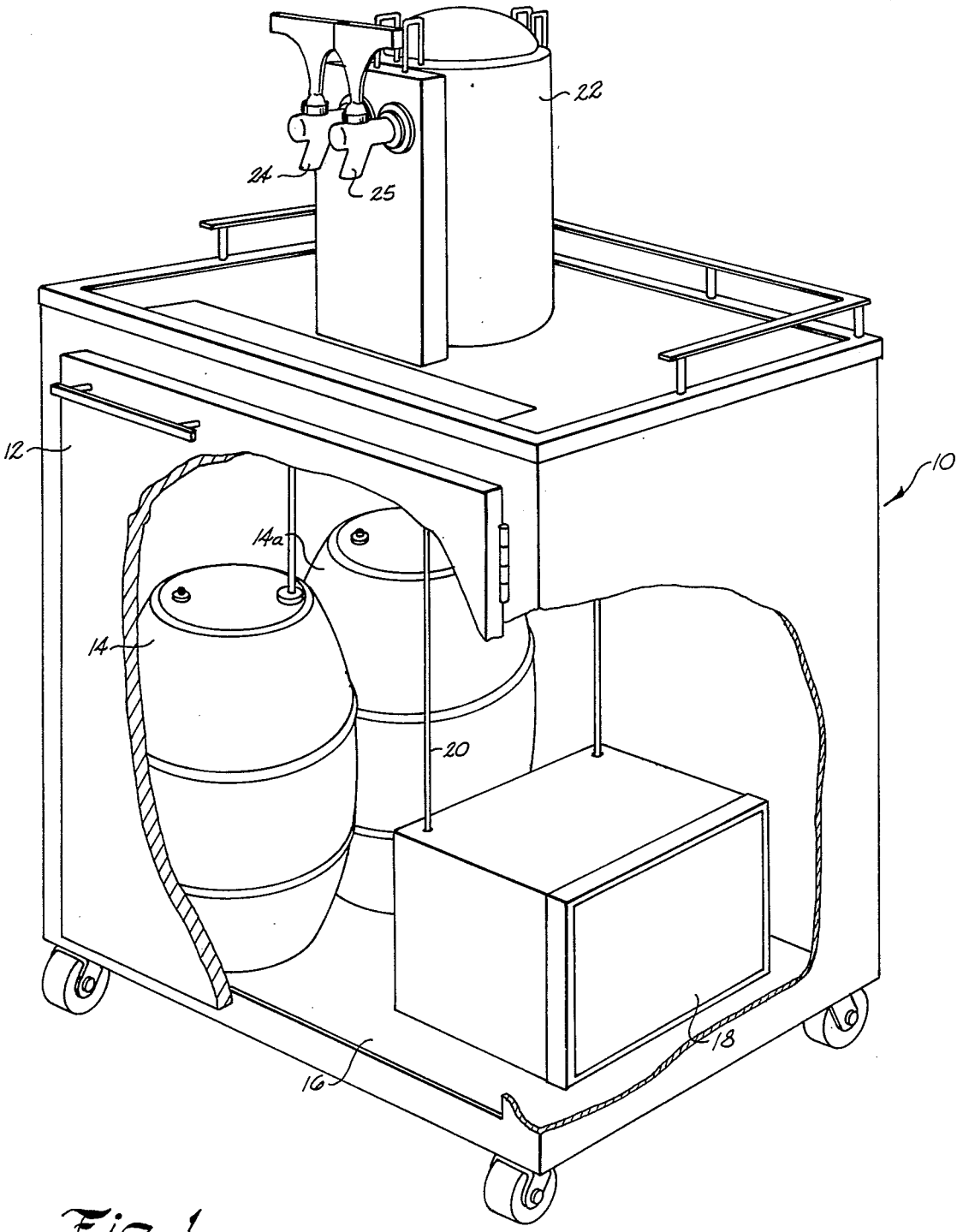
FIG. 1 is a perspective view with parts broken away showing a mechanism for controlling the water circulation system associated with a beverage dispensing device.

Referring to FIG. 1 of the drawing, there is disclosed a cabinet generally designated by the reference character 10 which has a door 12 provided on the front thereof for permitting access to the interior. Kegs 14 and **14*a* of beer are positioned within the cabinet and supported on a bottom 16. It is understood, of course, instead of a keg of beer being positioned in the cabinet, packages of wine could also be positioned therein and dispensed therefrom. Also positioned within the cabinet is a refrigeration condensing means 18** which may be of any suitable conventional construction.

Extending outwardly from the refrigeration condensing means 18 is capillary tube 20 through which a refrigerant flows up to a container 22 carried on top of the cabinet. The container 22 is provided for cooling the beer as it flows from the kegs to convention ON/OFF faucets 24 and 25. The container 22 includes a cylindrical side wall 26 that is joined by a bottom wall 28 and a top 30. The top 30 has a cylindrical opening therein for receiving a cover 32 that has a motor 34 provided therein. Extending downwardly from the motor 34 is a shaft 35 which has an elongated rectangularly shaped paddle wheel 36 connected thereto. The purpose of the paddle wheel 36 is to gently circulate water that is carried within the container in a sweeping even motion.

An evaporator coil 38 is carried within the inside wall of the container and extends vertically upwardly from adjacent the bottom of the container to the top. The bottom of the evaporator coil 38 is connected directly to the capillary tube 20 extending from the compressor 18. The other end of the evaporator coil 38 is connected directly to the compressor 18.

Insulation 40 is provided between the inner wall 26 of the container and exterior wall 45.

The interior of the container is filled with water to a level closely adjacent the top of the container directly above the upper coil of the evaporator coil 38.

Figure 2:
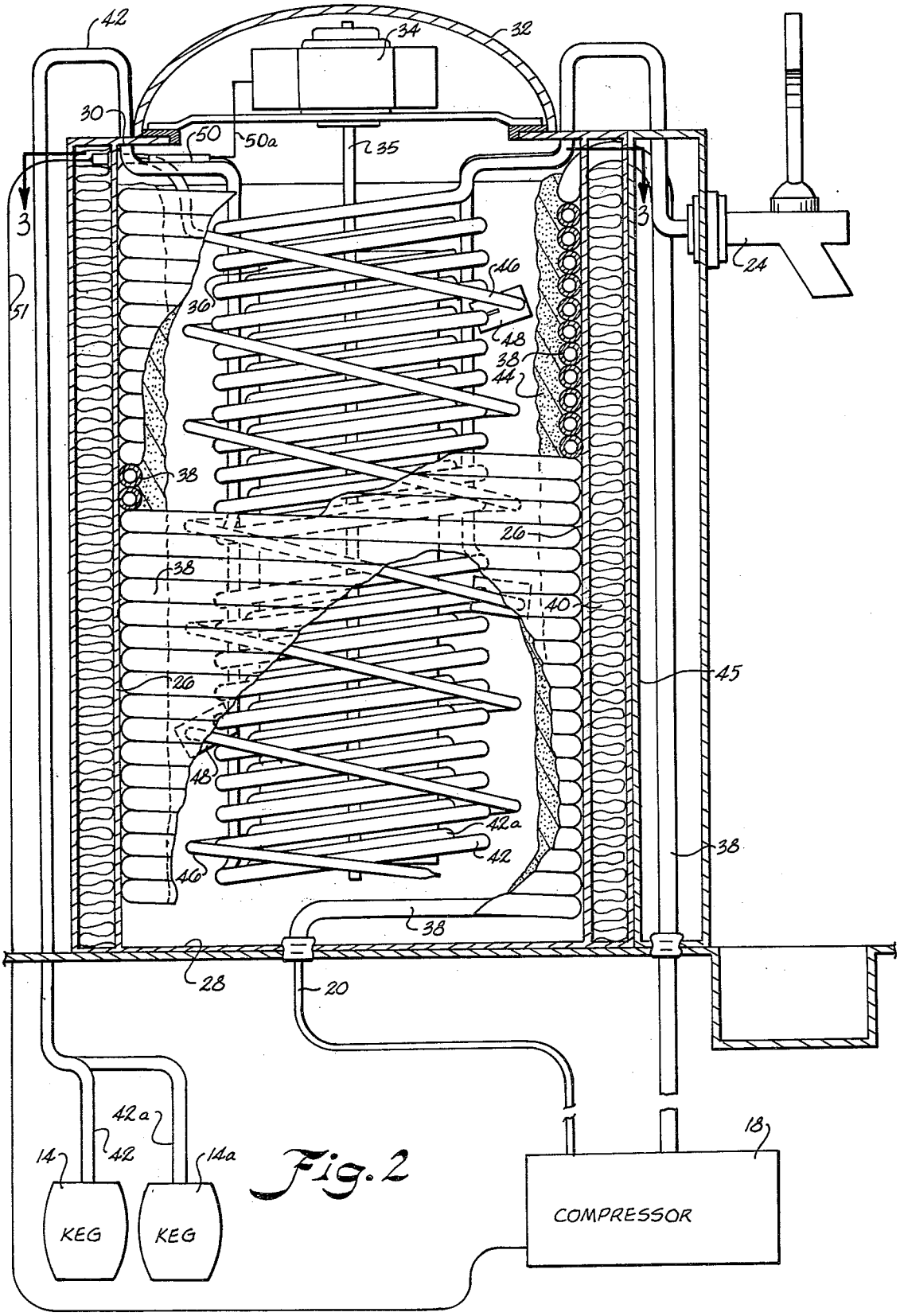
FIG. 2 is an enlarged sectional view of the refrigeration apparatus constructed in accordance with the present invention.
Figure 3:
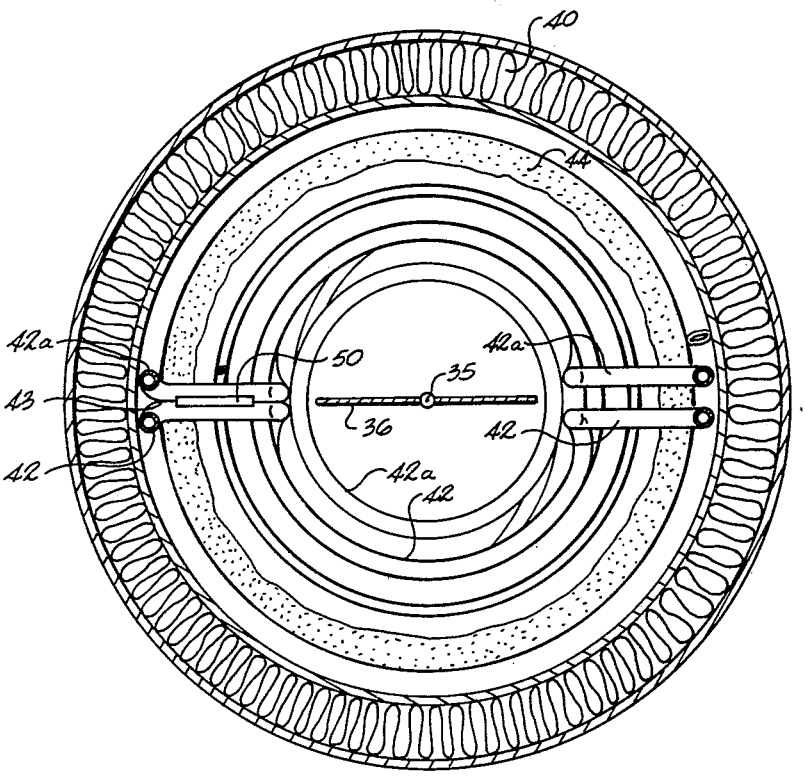
FIG. 3 is a cross sectional view taken along line 3—3 of FIG. 2.

A pair of beverage dispensing coils 42 and 42*a* extend from the kegs 14 and 14*a*, respectively, and enter the container through the top 30. As shown in FIG. 3, the beverage dispensing coils 42 and 42*a* are positioned in contact with each other to form a junction as at 43. From there, the tubes 42 and 42*a* extend downwardly directly to the bottom of the container and then are coiled upwardly into two coils 42 and 42*a*. The coil 42*a* is carried within the coil 42 as shown in FIG. 2. The upper end of the coils 42 and 42*a* are connected by continuing copper conduit to the respective faucets 24 and 25.

It is noted the paddle 36 is centrally located within the beverage dispensing coils 42 and 42*a*. The beverage dispensing coil 42 has an outside diameter which is less than the diameter of the container so as to provide a space between the evaporator coil 38 and the beverage dispensing coil 42. This space should be sufficient to allow a buildup of ice such as shown by the reference character 44 around the evaporator coil. This buildup of ice generally extends from the bottom of the container, closely adjacent the top.

A helical tube 46 is supported on brackets 48 and extends from adjacent the top of the container to adjacent the bottom and also encircles the beverage dispensing coils 42 and 42*a*. The brackets 48 are supported on the beverage dispensing coil 42 and maintain the helical tube 46 spaced therefrom. As can be seen in FIG. 2, the helical tube is positioned in the container between the ice bank 44 and the beverage dispensing coil 42. Inserted within the helical tube, which in one particular embodiment is a copper tube, is a temperature sensing probe, the end of which is connected by lead 51 to the compressor 18. As a result, if at any time the buildup of ice 44 comes close to the copper tube 46, it will immediately cut the compressor off since the temperature sensor probe is in heat transfer relation with the entire length of the copper tube. In one particular embodiment, the temperature sensor probe is approximately six feet long wih five feet extending into the copper tube 46 and one foot extending out the end thereof and being connected to the lead 51.

It is desirable that the motor 34 associated with the paddle 36 be turned on any time warm beverage is drawn from one of the kegs 42 and 42*a* for circulating the cold water within the container to cool the beverage passing through the beverage dispensing coils 42 and 42*a*. In order to accomplish this, a second temperature sensor 50 is secured in the junction of the tubes 42 and 42*a* at the point where the tubes enter into the container. As a result, when the faucets 24 are opened, the warm beverage coming from the kegs will first pass through the portion of the tubes 42 and 42*a* which supports the temperature sensor 50 prior to entering the main body of the coils. When the temperature rises above a predetermined value, it, in turn, energizes the motor 34 associated with the paddle 36 through electrical conductor 50*a*. This causes the water within the container to be circulated between the ice bank 44 and the beverage dispensing coils 42 and 42*a*. After the temperature of the portion of the tubes in which the sensor 50 is located drops below a predetermined value, the motor is turned back off. The helical tube 46 into which the elongated sensor is carried ensures that the buildup of ice on the inner wall of the container does not touch the beverage dispensing coil 42 and 42*a* which, if occurred, could possibly freeze the beverage therein and interfere with the dispensing of the beverage.

While a preferred embodiment of the invention has been described using specific terms, such description is for illustrative purposes only, and it is to be understood that changes and variations may be made without departing from the spirit or scope of the following claims.

We claim:

1. A refrigeration system for cooling a beverage as said beverage is withdrawn from a container comprising:

a housing having a vertically extending wall and a top and bottom;

water carried within said housing;

an evaporator coil carried adjacent the wall of said container extending vertically from adjacent the bottom of said container to adjacent the top of said container;

refrigeration condensing means circulating a refrigerant through said evaporator coil cooling said water carried in said container and building an ice bank along the inner wall of said container;

a pair of vertically extending beverage dispensing coils centrally carried within said container;

said beverage dispensing coils having a predetermined outside diameter so as to provide a space between said inside wall of said container and said beverage dispensing coils for allowing said bank of ice to build up on said inside wall;

a faucet connected to each of said beverage dispensing coils;

said beverage dispensing coils being connected between said container and said faucets for cooling said beverage as said beverage is drawn from said faucet;

a power driven paddle carried within said beverage dispensing coils for gently circulating water carried in said housing against said ice bank for cooling said water and said beverage dispensing coil;

inlet ends of said beverage dispensing coils being positioned side by side to form a junction;

a first temperature sensor carried within said housing between said ice bank and said beverage dispensing coils for deactivating said refrigeration condensing means responsive to the temperature of said water dropping below a predetermined temperature;

a second temperature sensor carried in said junction in heat transfer relation with said inlet ends of said beverage dispensing coils for sensing when beverage is being drawn from one of said containers; and means for operably connecting said second temperature sensor to said power driven paddle for activating said paddle responsive to beverage being drawn from either of said faucets.

2. The refrigeration system as set forth in claim 1 further comprising:

said paddle extending from adjacent the top of said container to adjacent the bottom for gently moving the water within said container when activated.

3. The refrigeration system as set forth in claim 1 further comprising:

a helical support coil extending from adjacent the top of said container to adjacent the bottom, and said first temperature sensor being an elongated temperature sensor carried in said helical support coil.

* * * * *